United States Patent [19]

Hildreth et al.

[11] Patent Number: 4,732,206

[45] Date of Patent: Mar. 22, 1988

[54] PLUNGER TIP HAVING A SAFETY INDICATOR SURFACE

[75] Inventors: Ray L. Hildreth; Leonard Furman, both of Marion, Ohio

[73] Assignee: Semco, Inc., Marion, Ohio

[21] Appl. No.: 218,441

[22] Filed: Dec. 19, 1980

[51] Int. Cl.[4] ..... B22D 17/08

[52] U.S. Cl. ..... 164/312; 29/407; 29/557; 51/323; 164/412; 82/1 C

[58] Field of Search ..... 82/1 C; 164/412, 312; 138/36; 175/39; 116/208; 51/323; 29/557

[56] References Cited

U.S. PATENT DOCUMENTS

| | | | |
|---|---|---|---|
| 1,996,346 | 4/1935 | Mueller | 29/407 UX |
| 2,233,403 | 3/1941 | Dickinson et al. | 138/36 X |
| 3,050,027 | 8/1962 | Borneman | 116/208 X |
| 3,864,815 | 2/1975 | Koch | 164/112 X |

*Primary Examiner*—Nicholas P. Godici
*Assistant Examiner*—J. Reed Batten, Jr.
*Attorney, Agent, or Firm*—Cushman, Darby & Cushman

[57] ABSTRACT

A metal plunger tip for use in aluminum die casting operations includes a cylindrical body having an axially extending cavity therein and a shank of smaller diameter extending axially from the body for connection to a control rod. The plunger tip has at least one outwardly-facing safety indicator surface located at which a point intermediate the inside and outside diameters of the body, for the purpose of indicating the extent to which the outer surface of the body can be machined without reducing the wall thickness to an unsafe dimension.

7 Claims, 5 Drawing Figures

PLUNGER TIP HAVING A SAFETY INDICATOR SURFACE

This invention relates to the construction of a metal plunger tip such as is used in aluminum die casting operations.

BACKGROUND AND SUMMARY OF THE INVENTION

A plunger tip for use in aluminum die casting is a closed end metal cylinder having an axial cavity therein and a shank of smaller diameter at the other end. The shank is connectable to a control rod or the like, as by having a threaded bore. Typically, the plunger tip is made of cast beryllium-copper alloy.

Purchasers of the plunger tips frequently machine the cylinders to a slightly smaller outside diameter. On occasion the machining operation may reduce the wall thickness of the cylinder to such a degree that the wall will crack or break during use, thus resulting in failure of the plunger tip.

According to the present invention the plunger tip is provided with an indicator surface which indicates the extent to which the cylinder can be reduced in diameter without reducing the wall thickness to a dimension which might cause failure of the plunger tip during use. The indicator surface is an external outwardly facing surface on the plunger tip located intermediate the inside and outside diameters of the cylinder. In other words the outwardly facing indicator surface lies at a distance from the axis of the plunger tip which is equal to one-half the maximum safe outside diameter of the cylinder after machining. When the cylinder of plunger tip is machined (by mounting the tip in a lathe, rotating it about its axis and cutting away metal from the cylinder), the outside diameter is reduced to not less than the outside diameter of the rotational path of the indicator surface. The relationship between this path and the outside diameter of the cylinder is easily determined by the machinist by observation during the machining operation.

When the junction between the end of the cylinder and the shank is located at a shoulder, as is typically the case, the safety indicator surface may be conveniently the outer surface of a projection located on the shank immediately adjacent the shoulder because this allows the machinist to easily compare the outside diameter of the cylinder with the rotational path of the indicator projection. The indicator projection is preferably cast integrally with the shank of the plunger tip. It can, however, be secured to the shank subsequent to casting. The shape and number of projections is not critical. When the shank is cylindrical the projection may be a circumferential bead. If the shank is hexagonal in cross-section or otherwise has flat surfaces, one or more of the flat surfaces may be provided with a small boss.

The indicator surface may also be all or part of the external surface of the shank, without there being provided a special projection. For example, if the shank is hexagonal or square or otherwise has flat surfaces which intersect each other at lines located at the maximum diameter of the shank, any one of the lines of intersection can be the indicator surface provided that the cross-sectional size and shape of the shank is such that the line occurs at the desired distance from the axis of the tip.

The indicator surface may also be a surface on the cylinder itself. For example, the surface can be formed by an annular shoulder on the cylinder at one end thereof, such as the end adjacent the shank. The surface can also be formed by the bottom of an annular groove in the cylinder or the bottom of one or more recesses in the cylinder.

DETAILED DESCRIPTION

Figure 1:
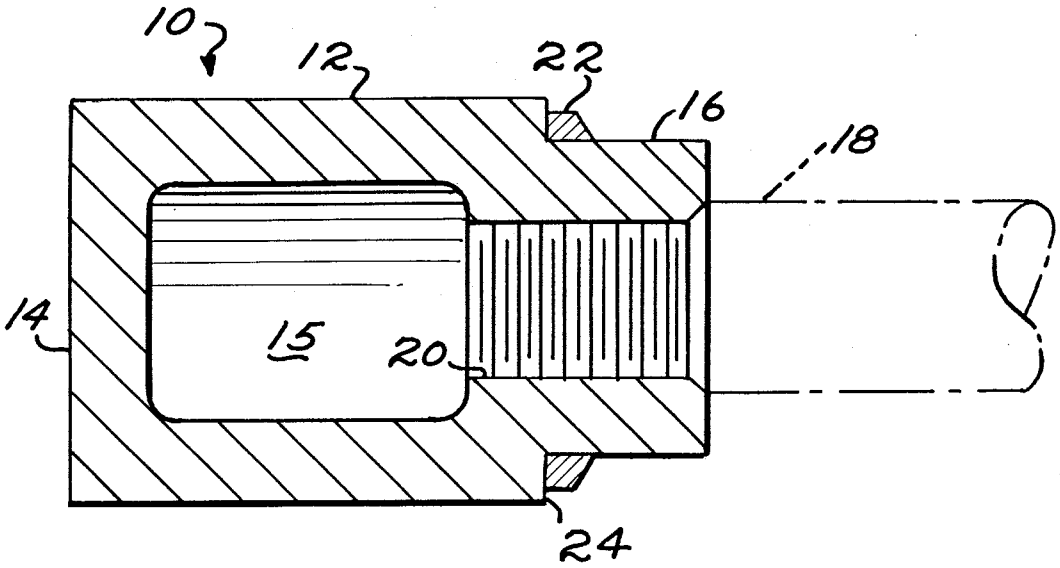
FIG. 1 is an axial sectional view of a plunger tip embodying the principles of the present invention.

FIG. 1 illustrates in axial cross-section a metal plunger tip 10 for use in aluminum die casting. The tip includes a cylindrical body 12 having a closed end 14 and a cylindrical cavity 15 extending coaxially with the diameter of the body 12. A cylindrical shank 16 of smaller diameter than the body 12 extends axially from the opposite end of the body 12. The shank 16 is adapted to be connected to one end of a control rod 18. A threaded bore 20 in shank 16 may serve this purpose.

The plunger tip 10 is illustrated in the form as manufactured and shipped to the aluminum die casting customer. The customer frequently will reduce the size of the tip somewhat by machining the cylindrical body 12 to a smaller diameter. This, of course, reduces the thickness of the wall of the body 12. If the wall becomes too thin it is liable to break during use. The present invention provides a safety indicator 22 which projects outwardly from the shank 16 to guide the machinist so that he will not reduce the outside diameter to an unsafe dimension. The indicator 22 projects from the shank 16 a distance such that its outer surface lies intermediate the inside diameter and the outside diameter of the cylindrical body 12. When the plunger tip 10 is rotated about its axis, the outer surface of the rotational path of the indicator 22 represents the minimum safe diameter of the body 12 and hence represents the minimum safe wall thickness of the body 12. The most useful location for the indicator is close to the inner end of the body 12 because this enables the machinist to easily observe the rotational path of the indicator 22 during the machining operation. The machinist can therefore discontinue the cutting operation as soon as the tip of the indicator begins to be cut. Alternatively, the lathe can be adjusted initially to make an automatic cut which reduces the diameter of the body 12 only to the diameter of the path of the indicator 22. Typically, the body 12 forms a shoulder 24 at its junction with the shank 16, and the indicator is located at this shoulder 24.

In this embodiment of FIG. 1, the shank 16 is cylindrical and the indicator 22 is in the form of a continuous circumferential bead cast on the shank 16 when the plunger tip is cast. The bead need not be continuous, however.

Figure 2:
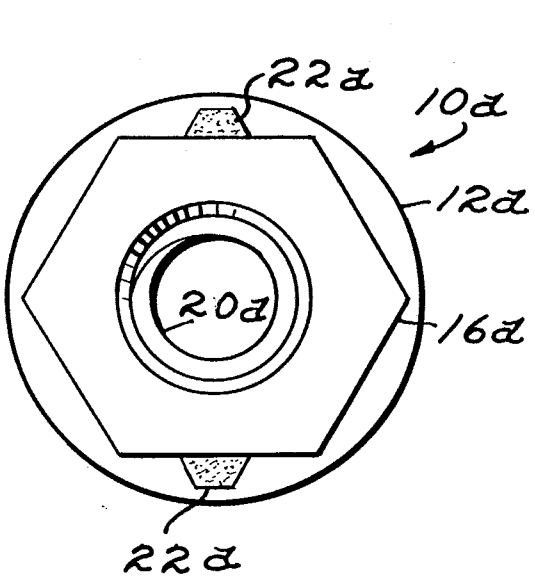
FIG. 2 is an end view of a second plunger tip embodying the invention.

FIG. 2 illustrates a second plunger tip **10*a*, having a body 12*a*, which differs from the FIG. 1 construction in the shape of the shank 16*a* and the shape of the indicator 22*a*. In the FIG. 2 construction the shank 16*a* is hexagonal and the indicator 22a has the form of a small boss on to opposite flat sides of the shank 16a**.

Figure 3:
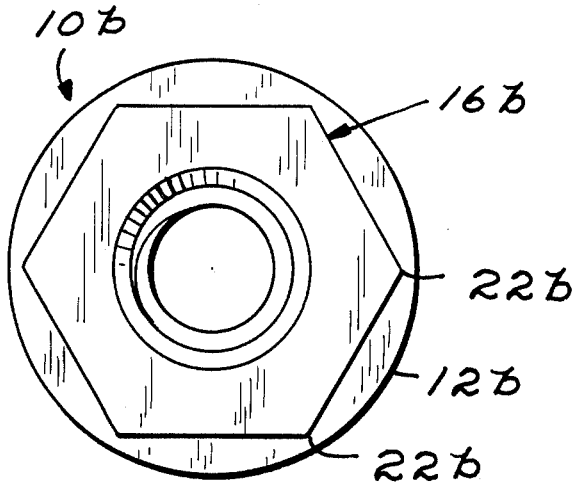
FIG. 3 is an end view of a third plunger tip embodying the invention.

In the embodiment of FIG. 3 the shank 16b is hexagonal as in FIG. 2. In FIG. 3, however, the indicator 22b is formed by the lines of intersection of the flat surfaces; that is, the maximum cross-sectional dimension of shank 16b is such that each intersection line is located at a distance from the axis of the plunger tip 10b corresponding to the maximum safe radius of the cylinder 12b.

Figure 4:
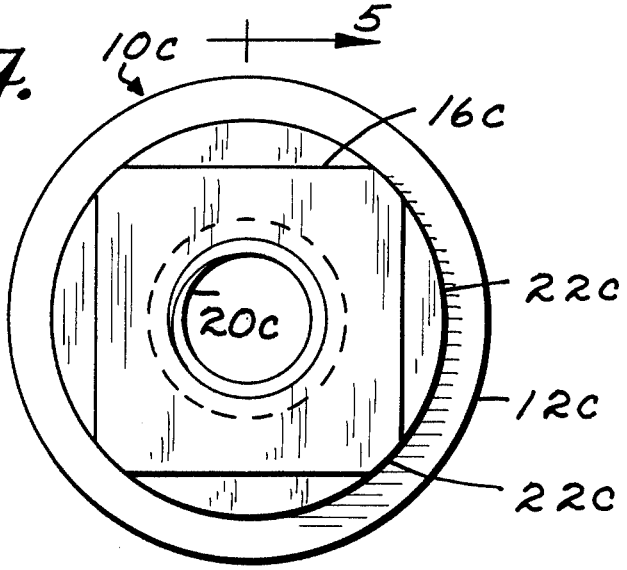
FIG. 4 is an end view of a fourth plunger tip embodying the invention.
Figure 5:
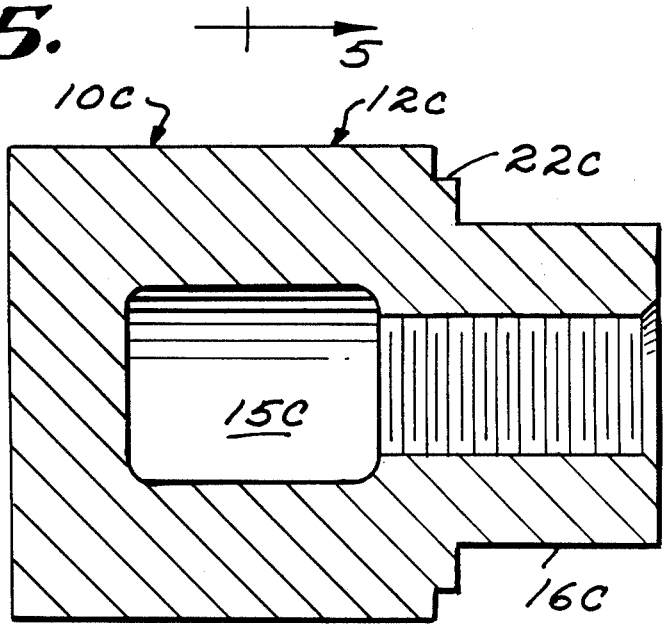
FIG. 5 is a sectional view on line 5—5 of FIG. 4.

In the plunger tip 10c of FIGS. 4 and 5 the indicator surface 22c is an annular surface of a shoulder formed in an end of the cylinder 12c. The shank 16c is essentially square in cross-section and is sufficiently large that the corners of the square are rounded off by the indicator surface 22c. The indicator surface 22c thereby exists partly on the cylinder 12c and partly on the shank 16c. The shank 16c has a bore 20c in communication with an internal cavity 15c.

What is claimed is:

1. A metal plunger tip for use in aluminum die casting operations comprising a cylindrical body closed at one end and having an axially extending cavity therein whereby the body has a wall thickness determined by the distances of the interior and exterior surfaces of the body from the axis of the plunger tip, and a shank extending axially from the other end of the body, the body forming a shoulder at the junction between the body and the shank and the shank having a transverse dimension less than the outside diameter of the body; and at least one outwardly facing safety indicator surface located at a point intermediate the interior and exterior surfaces of the body for indicating the extent to which the outside diameter of the body can be reduced by machining without reducing the wall thickness of the body to an unsafe dimension, said safety indicator surface being the outwardly facing surface of a projection on the shank, the projection being located immediately adjacent the shoulder.

2. A plunger tip as in claim 1 wherein the projection is a bead extending around the outside of the shank.

3. A plunger tip as in claim 1 wherein there are a plurality of circumferentially spaced apart indicator projections.

4. A plunger tip as in claim 1 constructed of beryllium copper.

5. A plunger tip as in claim 1 wherein the shank is internally threaded to enable the plunger tip to be connected to a control rod.

6. A metal plunger tip for use in aluminum die casting operations comprising a cylindrical body closed at one end and having an axially extending cavity therein whereby the body has a wall thickness determined by the distances of the interior and exterior surfaces of the body from the axis of the plunger tip, and a shank extending axially from the other end of the body, the shank having a transverse dimension less than the outside diameter of the body and the shank exhibiting at least two flat surfaces which intersect along a line extending parallel to the axis of the plunger tip, said line forming an outwardly facing safety indicator surface located at a point intermediate the interior and exterior surfaces of the body for indicating the extent to which the outside diameter of the body can be reduced by machining without reducing the wall thickness of the body to an unsafe dimension.

7. A metal plunger tip for use in aluminum die casting operations comprising a cylindrical body closed at one end and having an axially extending cavity therein whereby the body has a wall thickness determined by the distances of the interior and exterior surfaces of the body from the axis of the plunger tip, and a shank extending axially from the other end of the body, the shank having a transverse dimension less than the outside diameter of the body and the cylindrical body having at one end thereof an outwardly facing shoulder which forms an outwardly facing safety indicator surface located at a point intermediate the interior and exterior surfaces of the body for indicating the extent to which the outside diameter of the body can be reduced by machining without reducing the wall thickness of the body to an unsafe dimension.

* * * * *